United States Patent [19]

Maine

[11] 3,996,620

[45] Dec. 14, 1976

[54] RADIATION SHIELD APRON CONSTRUCTION

[76] Inventor: Gayle J. Maine, 788 N. Ninth St., Redmond, Oreg. 97756

[22] Filed: Mar. 28, 1975

[21] Appl. No.: 563,214

[52] U.S. Cl. ..... 2/2; 2/48

[51] Int. Cl.[2] ..... G21F 3/02; A41D 13/04

[58] Field of Search ..... 2/2, 2.5, 48, 51, 52, 2/92, DIG. 7

[56] References Cited

UNITED STATES PATENTS

| | | | |
|---|---|---|---|
| 1,413,569 | 4/1922 | Bloch | 2/51 |
| 2,404,225 | 7/1946 | Green | 2/48 X |
| 3,093,829 | 6/1963 | Maine | 2/2 |
| 3,727,236 | 4/1973 | Llyoyd | 2/51 |

FOREIGN PATENTS OR APPLICATIONS

| | | | |
|---|---|---|---|
| 370,525 | 4/1932 | United Kingdom | 2/48 |

*Primary Examiner*—Werner H. Schroeder
*Assistant Examiner*—Peter Nerbun
*Attorney, Agent, or Firm*—Klarquist, Sparkman, Campbell, Leigh, Hall & Whinston

[57] ABSTRACT

A radiation shield apron includes a front apron panel for covering the front of the body from the neck and shoulder tops to at least the knees with inner and outer cover sheets of fabric and multiple flexible sheets of radiation shielding material between the cover sheets and coextensive therewith. A pair of broad-backed wing panels are joined to the front panel along the top shoulder lines and side edges of the front panel. Each wing panel forms a broad combination one-piece shoulder and tie band which ties at the waist at the front of the apron to distribute the weight of the front panel broadly and evenly across the shoulders, chest, back and hips of the wearer for maximum comfort and minimum fatigue.

2 Claims, 8 Drawing Figures

RADIATION SHIELD APRON CONSTRUCTION

BACKGROUND OF THE INVENTION

1. Field of the Invention

The present invention relates to an apron or apron-like garment for protecting the wearer from harmful X rays and other radiation.

2. Description of the Prior Art

Radiation shield aprons are of two general types. One type is for use by patients who normally assume a sitting or prone position while exposed to radiation. This type of shield apron need not have any full shoulder straps, neck ties or bands or waist ties because the apron can be supported simply by draping it over the body. A shield apron of this type is shown in U.S. Pat. No. 3,093,829.

The other type of apron is for use by doctors, dentists, x-ray technicians and others who are normally exposed to radiation sources while working in standing or erect positions. With this type of apron, more elaborate means must be used to support the apron on the body because of the heavy weight of the shielding material of the apron. Most shield aprons of this type have neck ties or shoulder straps and waist ties to hold the apron on the body. However, because of the design of such aprons, particularly the narrow ties or straps at the neck or shoulders common to such aprons, most of the apron's weight is borne by a narrow area across the wearer's neck or shoulders, making such aprons uncomfortable and fatiguing to wear.

Another problem with most shield aprons of the last-mentioned type is that the narrow neck and waist ties, which are usually just sewn or riveted at their ends to one point of the apron body, tend to pull away and separate from the apron body because of the heavy stress imposed on such ties and their connections to the apron. This problem is illustrated by the shield apron shown in U.S. Pat. No. 2,404,225, wherein each of two narrow waist ties is attached at one end to a back panel of the apron at one point that would be placed under great stress.

SUMMARY OF THE INVENTION

The present invention is an improvement in shield aprons designed for use by workers exposed to radiation. In particular the invention is a shield apron of the general type shown in U.S. Pat. No. 2,404,225, having an improved integral shoulder, back and waist band wrap-around construction which eliminates the waist and neck tie separation problem of prior aprons. The improved wraparound construction also provides greater comfort and less fatigue to the wearer through improved weight distribution over greater areas of the wearer's body than prior shield aprons. Because of the ability of the tie bands to withstand high stresses, the bands can be drawn snugly across the wearer's back and tied tightly at the waist to hold the apron close to the wearer's body at all points and to transfer some of the apron's weight to the wearer's hips.

The improved shield apron construction is characterized by a pair of back wing panels of double-thickness high-strength fabric which join a heavy front panel at long double-stitched seams along the full length of the shoulder tops and along a substantial length of the sides of the front panel beneath the arms. The onepiece back wing panels provide integral, combination broad shoulder and waist band portions. When the waist band portions are drawn across the back and around the waist and tied at the front, the back wing panels are caused to overlap at the center of the back, thereby helping to maintain the shoulder bands on the shoulders of the wearer and drawing the front panel close to and around the sides of the wearer's body for optimum protection and comfort.

The foregoing and other objects, features and advantages of the present invention will become more apparent from the following detailed description which proceeds with reference to the accompanying drawings.

DETAILED DESCRIPTION

Figure 4:
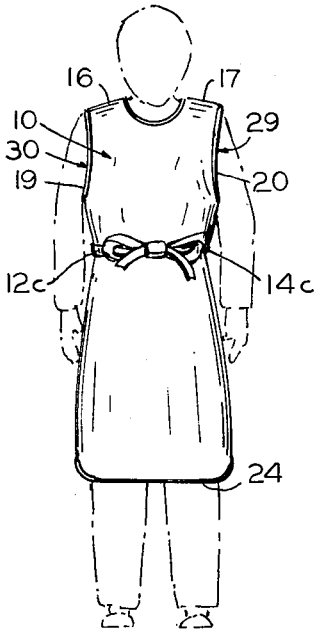
FIGS. 4, 5 and 6 are front, side and rear views, respectively, of the apron as it appears when worn.

Referring to the drawing, the shield apron of the invention consists essentially of only three distinct body portions, namely, a front shield panel 10 and a pair of separate back wing panels 12, 14. As apparent from FIGS. 4, 5 and 6, front panel 10 extends downwardly from the tops of the shoulders and base of the neck to at least about knee level of the wearer and from side to side across the front and around the opposite sides of the wearer. The front panel 10 may be considered as subdivided into main body portion 10*a* and shoulder portions 10*b*, 10*c*, the latter defined by top shoulder seam lines 16, 17, a slightly scooped neckline 18, and upper arm lines or edges 19, 20. The front shield panel is also bounded by opposite vertical side edges 22, 23, below the arm lines and a horizontal bottom edge 24, with the front panel being generally rectangular in shape.

Figure 7:
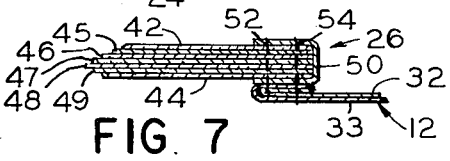
FIG. 7 is a sectional view taken along the lines 7—7 of FIG. 1.

The two back wing panels 12, 14 may be considered as subdivided into integral shoulder band portions 12*a*, 14*a*, side band portions 12*b*, 14*b*, and waist tie band portions 12*c*, 14*c*. The shoulder band portions of the back wing panels are joined to the front panel at top shoulder lines 16, 17 to form a straight shoulder seam which extends across the full width of the shoulders. The side band portions of the back wing panels are joined to the opposite side edges 22, 23 of the front shield panel along long seams 26, 27 extending from the lower end of armlines 19, 20 of the front panel to below the waist level. In an actual apron construction, the side seams are each approximately 12 inches long and the shoulder seams are each about 6 inches long. The connected front and back wing panels define together a pair of opposite arm openings between shoulder seams 16, 17 and side seams 26, 27, such openings being identified at 29, 30. The details of the side seams, which are of double-stitched construction, are shown in FIG. 7. This detail also applies to the top seams at 16 and 17, which are of identical construction.

Figure 8:
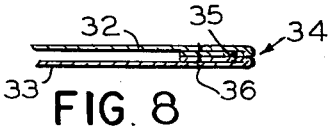
FIG. 8 is a sectional view taken along the lines 8—8 of FIG. 3.

Each back wing panel 12, 14 is formed of a double thickness, high-strength fabric, such as a high-strength nylon, joined at double-stitched edge seams as shown in FIG. 8. The two fabric layers of the back panels include an outer layer 32 and inner layer 33 joined at edge seams 34 by a first inside line of stitching 35 and a second line of top stitching 36, providing a high-strength tear resistant seam.

No interior shielding layers of material need be provided between the fabric layers 32, 33 of the back panels.

Figure 3:
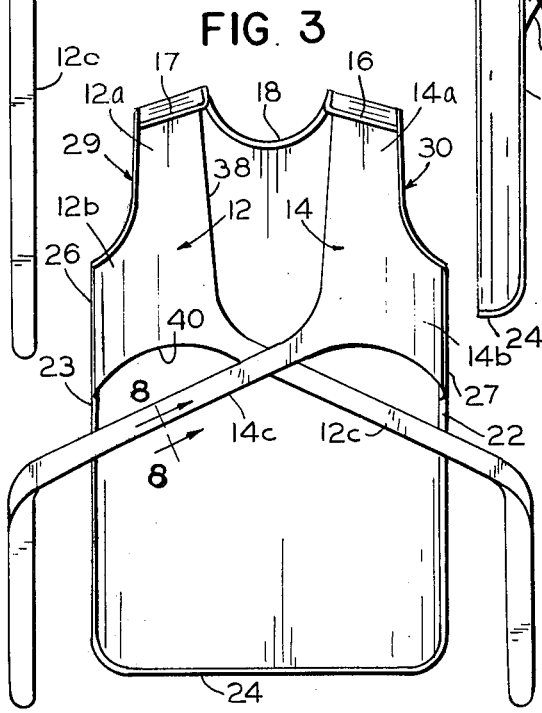
FIG. 3 is a rear view of the apron of FIG. 1.

Considering the shape of the back panels as shown in FIG. 3, each such panel includes a generally vertically extending inner edge line 38 of the shoulder band portion which extends from an intersection of neckline edge 18 and shoulder seams 16, 17 of the front panel downwardly and gradually inwardly toward the center of the back. Each back panel also includes a bottom edge 40 of the side band portion sweeping in an arc upwardly and inwardly from the lower end of the side seam below waist level toward the center of the back. These inner and bottom edges converge near the center of the back and then extend generally parallel to one another downwardly and across the back to form the wide, flat and long tie band portion. Thus the tie bands are integral onepiece continuations of their back wing panels and are of sufficient length to be tied at waist level at the center of the front panel. The two back wing panels are of identical size and configuration.

Referring again to the front shield panel construction, such panel consists of several layers of material including outer front and back cover sheets 42, 44 of non-shielding, high-strength fabric such as nylon material. Between the front and back cover sheets are one or more inner sheets of flexible radiation shielding material. In the illustrated embodiment there are five such inner sheets indicated at 45–49. These inner sheets typically comprise multiple layers of flexible lead sheeting, the number of sheets used being determined by the degree of protection desired. For example, one flexible lead sheet of 0.015 mm thickness, available in the industry, is equal to 0.01 mm thickness of pure lead. Thus if 0.05 mm of lead protection is required, five layers of the flexible lead sheeting of the indicated thickness are used in the apron.

The composition and arrangement of the protective flexible sheets of shielding material used in the apron form no part of the present invention. Such sheets are well known in the field and available from suppliers. The composition of such sheets is also disclosed in numerous prior patents, including the aforementioned U.S. Pat. No. 2,404,225, and in U.S. Pat. Nos. 3,093,829; 2,858,451; 3,052,799; and 3,514,607.

Figure 1:
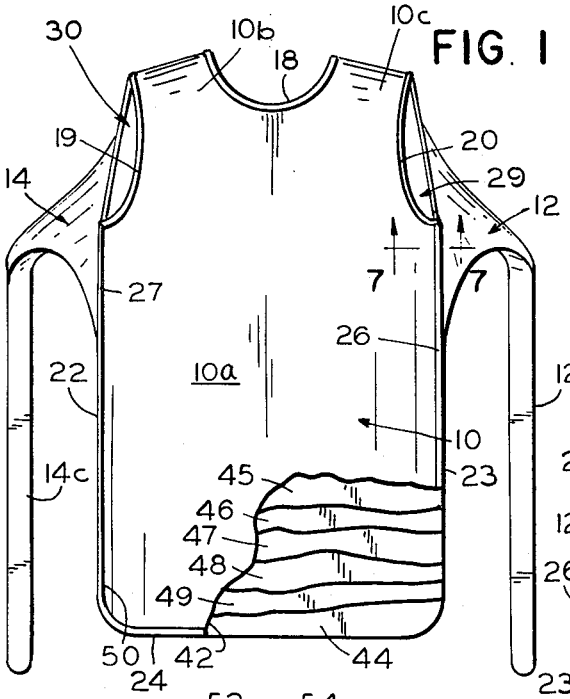
FIG. 1 is a front view of a shield apron in accordance with the invention with a portion of the front panel cover removed to reveal the interior construction.
Figure 2:
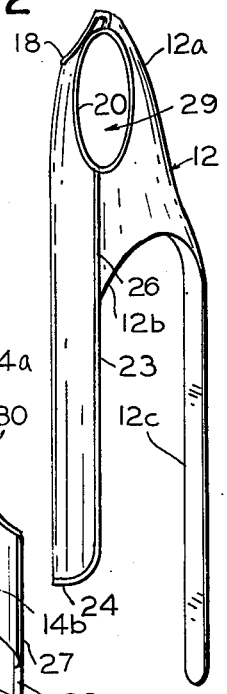
FIG. 2 is a side view of the apron of FIG. 1.

As previously mentioned, all sheets, including the front and back fabric cover sheets and the inner shielding sheets, are coextensive throughout the area of the front apron panel. All such sheets are joined together by double stitching at edge seams throughout the periphery of the front panel. All such seams are formed with heavy fabric binding tape 50 enclosing the edges of all the sheets. The edge seam shown in FIG. 7 for this purpose is typical with the exception that the seam of FIG. 7 also includes the connection of a back wing panel. In FIG. 7 the binding tape 50 encloses front cover sheet 42, back cover sheet 44, and the inner shielding layers 45–49. Two lines of stitching 52, 54 extend from one side of the binding tape through all seven layers of material of the front panel and through the opposite side of the binding tape to bind all of the sheets of the front panel together as a unit at their edges. In FIG. 1 the seam tape 50 will be observed extending, not only along the bottom and side edges, but also along the arm lines 19, 20, the top shoulder lines 16, 17 and the neckline 18 of the front panel.

Figure 5:
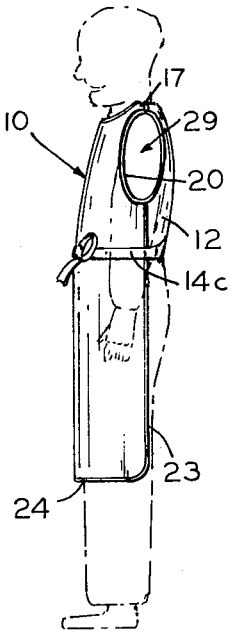
Figure 6:
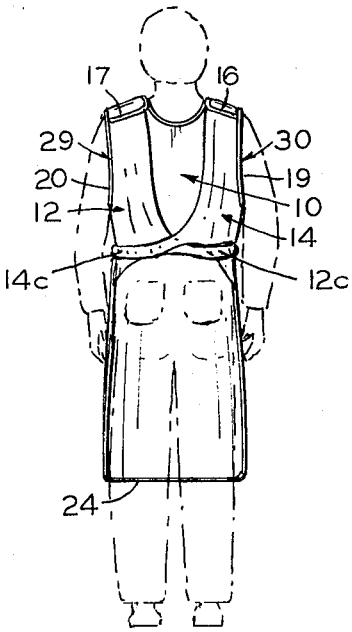

The foregoing-described apron construction is designed for maximum comfort and durability. The wearer puts the apron on simply by slipping his arms through the two armholes 29, 30 and then drawing the two wide tie bands 12*c*, 14*c* snugly across his back and around the sides and front of the apron and then tying them at the front center of the apron at about waist level to achieve a wrap-around effect. The tie bands thus tied draw the back wing panels 12. 14 together in overlapping relationship at the center of the back. Because of the design of the back panels, they draw the front panel close to the body throughout, including in the chest and leg areas, and wrap the front panel around the sides of the body as shown in FIG. 5 when placed in tension by the tie bands. The tensile forces transmitted by the waist tie bands through the back panels also tend to retain the shoulder bands on the shoulders of the wearer, as will be apparent from FIG. 6. Furthermore, when the tie bands are tied snugly at the waist, the weight of the apron below waist level becomes at least partially supported on the hips, thereby relieving the chest, shoulders, and back of some of the apron's heavy weight. Thus worn, the heavy apron hugs the body closely rather than hanging loosely from the shoulders, thereby reducing fatigue by supporting its weight over broad areas of the body.

The elimination of any seams between the tie bands and the remaining portions of the back wing panels prevents any possibility of the waist bands ripping out from the remainder of the apron from continual stress and pull. Moreover, since the back wing panels themselves are joined to the front panel along long double-stitched seams both at the shoulders and sides, the stress at any given point along these seams is minimal, and therefore there is little chance that these seams will rip out in normal wear.

Having illustrated and described what is presently a preferred embodiment of my invention, it should be apparent to persons skilled in the art that such embodiment may be modified in arrangement, detail and composition. I claim as my invention such embodiment and its equivalents and all such modifications as come within the true spirit and scope of the accompanying claims.

I claim:

1. A radiation shield apron comprising:

a generally rectangular front shield panel for shielding the front of the body from radiation, said front panel extending continuously vertically from top shoulder line and neckline edges to a generally horizontal bottom edge below body waist level and horizontally to generally vertical opposite side edges, said front panel being of sufficient width to wrap at least partially around the opposite sides of the body when worn, said front panel including front and back cover sheets of non-shielding fabric material and multiple thin flexible inner sheets of radiation shielding material, said inner sheets being coextensive with said front and back cover sheets and being joined to said cover sheets at least along said top shoulder line, neckline and side edges of said front panel, a pair of separate seamless one-piece broad back wing panels extending when worn over the shoulder blade portions of the back of the body from the tops of the shoulder to at least waist level, said back wing panels being joined to said front panel at shoulder seams extending substantially full shoulder width along the full length of said top shoulder line edges and at long side seams extending along said vertical side edges of said front panel from just below armpit level to at least waist level so as to define with the connected said front panel a pair of arm openings between said shoulder and side seams, each of said back wing panels being of double thickness, high-strength, non-shielding fabric material and including a generally vertically extending inner edge extending from an inner end of one of said shoulder seams downwardly and gradually inwardly toward the center of the back, and a bottom edge extending in an arc upwardly and inwardly from a lower end of one of said side seams toward the center of said back, said inner edge and said bottom edge of each said back wing panel converging near the center of the back at about waist level and then extending generally parallel and in spaced relationship across the back to define a wide, flat and long tie band portion forming an integral seamless one-piece cotinuation of said back wing panel, such that there are no seams between said tie band portion and other portions of said back wing panel, each said tie band portion being of sufficient length to be tied at waist level at the center of said front panel with the other said tie band portion so as to draw said back wing panels together in overlapping relationship at the center of the back, such that said tie band portions when drawn snugly across the back and tied together at the front of the apron exert forces tending to wrap said front panel closely around the sides of the body and maintain said front and back panels close to the body to distribute the weight of said front panel over a wide body area including the chest, shoulders, back, waist and hips.

2. An apron according to claim 1 wherein said front panel and said pair of back wing panels both include top shoulder line edges extending across substantially the full width of the shoulder and joined together at said shoulder seams throughout their full widths.

* * * * *